US007298968B1

(12) United States Patent
Boros et al.

(10) Patent No.: US 7,298,968 B1
(45) Date of Patent: Nov. 20, 2007

(54) PUMPLESS COMBINATION INSTANTANEOUS/STORAGE WATER HEATER SYSTEM

(75) Inventors: Jozef Boros, Montgomery, AL (US); William T. Harrigill, Montgomery, AL (US); Subbu Thenappan, Hillsborough, NJ (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 11/620,311

(22) Filed: Jan. 5, 2007

(51) Int. Cl.
*F24H 1/10* (2006.01)
*H05B 3/78* (2006.01)

(52) U.S. Cl. ..... 392/494; 392/441; 392/450

(58) Field of Classification Search ..... None
See application file for complete search history.

(56) References Cited

U.S. PATENT DOCUMENTS

| | | | | |
|---|---|---|---|---|
| 2,604,265 | A | 7/1952 | Thomas | |
| 3,885,584 | A | 5/1975 | Hock | |
| 4,246,764 | A | 1/1981 | Papadakos | |
| 4,977,885 | A | 12/1990 | Herweyer et al. | |
| 5,056,712 | A | 10/1991 | Enck | |
| 5,323,803 | A | 6/1994 | Blumenauer | |
| 5,524,666 | A | 6/1996 | Linn | |
| 5,588,088 | A | 12/1996 | Flaman | |
| 5,701,387 | A | 12/1997 | McGugan | |
| 5,983,922 | A | 11/1999 | Laing et al. | |
| 6,024,290 | A * | 2/2000 | Dosani et al. | 236/12.12 |
| 6,837,443 | B2 | 1/2005 | Saitoh et al. | |
| 6,861,621 | B2 * | 3/2005 | Ghent | 219/492 |
| 6,874,694 | B2 | 4/2005 | Saitoh et al. | |

FOREIGN PATENT DOCUMENTS

| | | |
|---|---|---|
| JP | 6306915 | 11/1994 |
| JP | 7011687 | 10/1995 |
| JP | 2003004303 | 1/2003 |
| WO | WO 01/44727 | 6/2001 |

OTHER PUBLICATIONS

Rinnai "2532 Series Water Heaters" drawings WH-1-SB and WH-1-R (Sep. 30, 2002).
Rheem "Tankless Water Heaters" Drawing No. 1102 ( Dec. 30, 2002).
Paloma "How it Works" Drawing (Nov. 11, 2005).
Combo Water Heater Series Connetction Figure #1 Drawing (Sep. 29, 2005).

* cited by examiner

*Primary Examiner*—Thor S. Campbell
(74) *Attorney, Agent, or Firm*—Haynes and Boone, LLP

(57) ABSTRACT

A representatively pumpless water heater system has an instantaneous water heater coupled in series with a storage water heater by piping circuitry incorporating a bypass valve and a mixing valve and useable to route pressurized incoming cold water sequentially through the instantaneous and storage type heaters. A control system (1) operates the bypass valve to cause a selectively variable portion of the incoming cold water to bypass the instantaneous heater and flow to the mixing valve, and (2) operates the mixing valve to blend the bypassed cold water with hot water exiting the storage heater to maintain a predetermined temperature of heated water exiting the system. Another system embodiment adds a directional bypass valve operable by the control system to selectively divert to the mixing valve a portion of the heated water exiting the instantaneous heater for delivery to the storage heater.

25 Claims, 2 Drawing Sheets

PUMPLESS COMBINATION INSTANTANEOUS/STORAGE WATER HEATER SYSTEM

BACKGROUND OF THE INVENTION

The present invention generally relates to liquid heating apparatus and, in representatively illustrated embodiments thereof, more particularly provides a specially designed, pumpless combination instantaneous/storage water heater system.

The on-demand supply of hot water to plumbing fixtures such as sinks, dishwashers, bathtubs and the like has for years been achieved using fuel-fired or electric water heaters in which a relatively large water storage tank is provided with a fuel-fired burner or one or more electric heating elements controlled to maintain pressurized, tank-stored water at a selectively variable delivery temperature—typically around 120 degrees Fahrenheit. Pressurized cold water from a source thereof is piped to the tank to replenish hot water drawn therefrom for supply to one or more plumbing fixtures operatively connected to the water heater.

Another conventional way of providing an on-demand supply of hot water to various plumbing fixtures is to use a tankless of "instantaneous" water heater in which water is flowed through a high heat input heat exchanger, without appreciable water storage capacity, so as to provide only as much hot water as needed by the open fixture(s). Where higher hot water flow rates than the instantaneous water heater can provide at the desired heated temperature are required, it has been conventional practice to connect a storage tank to the instantaneous water heater, in series therewith, to augment the hot water delivery capability of the instantaneous water heater with pre-heated storage tank water.

According to another conventional practice, a hot water recirculating loop with a circulating pump therein is operatively coupled to one or both of the instantaneous heater and storage tank to provide even faster delivery of hot water to the served fixtures. Despite the overall hot water production and delivery improvements provided by these conventional instantaneous/tank type water heater combinations, they present several well known problems, limitations and disadvantages.

For example, the necessity of providing a pump and its necessary controls undesirably builds in additional cost and complexity to the overall hot water supply system. Additionally, conventional combination systems of this general type tend to have rather rudimentary control formats with respect to efficiently coordinating the operation of the instantaneous water heater and associated storage tank from both flow rate and temperature control perspectives.

It would thus be desirable to provide an improved combination instantaneous/tank type water heater system in which (1) the circulating pump, with its attendant complexity and cost, was eliminated, and (2) the system was provided with improved temperature and flow rate control. It is to this design goal that the present invention is primarily directed.

SUMMARY OF THE INVENTION

In carrying out principles of the present invention, in accordance with representatively illustrated embodiments thereof, specially designed, representatively pumpless fluid heating apparatus is provided which comprises an instantaneous fluid heater, a fluid storage vessel, and flow circuitry, interconnected between the instantaneous fluid heater and the fluid storage vessel. Via the flow circuitry an incoming fluid may be sequentially flowed through the instantaneous fluid heater and the fluid storage vessel for discharge from the apparatus as heated fluid.

The flow circuitry, which is representatively piping interconnecting the instantaneous fluid heater in series with the fluid storage vessel, has incorporated therein (10 an incoming fluid bypass structure, representatively a bypass valve, operable to cause a selectively variable portion of the incoming fluid to bypass the instantaneous fluid heater, and (2) a mixing structure, representatively a mixing valve, operable to blend the bypassed fluid and heated fluid exiting the fluid storage vessel to maintain a predetermined temperature of heated fluid discharged from the apparatus. Suitable apparatus is provided for automatically controlling the bypass and mixing valves, representatively as a function of various sensed fluid temperatures in the system.

The flow circuitry may further incorporate therein a directional fluid bypass structure, representatively a directional bypass valve controlled by the aforementioned control apparatus, operable to receive heated fluid exiting the instantaneous fluid heater and flow selectively variable portions of the exiting heated fluid respectively to the mixing valve and the fluid storage vessel. In this embodiment of the fluid heating apparatus the mixing valve is further operable to blend fluid it receives from the directional fluid bypass valve with the bypassed fluid and the heated fluid exiting the fluid storage vessel to maintain the predetermined temperature of heating fluid discharged from the apparatus.

Illustratively, the fluid heating apparatus is water heating apparatus, with the instantaneous fluid heater being a fuel-fired instantaneous type water heater, and the fluid storage vessel being the water storage vessel being the tank portion of a storage type water heater having an electrical heating section used to selectively add heat to water disposed within the tank. However, principles of the present invention are not limited to water heater heating and may be advantageously employed with a variety of other types of fluids to be heated.

Preferably, the combination instantaneous/storage type fluid heating apparatus of the present invention is of a pumpless construction. However, if desired, a pumped fluid recirculation system could be suitably incorporated into the apparatus without departing from principles of the present invention.

DETAILED DESCRIPTION

Figure 1:
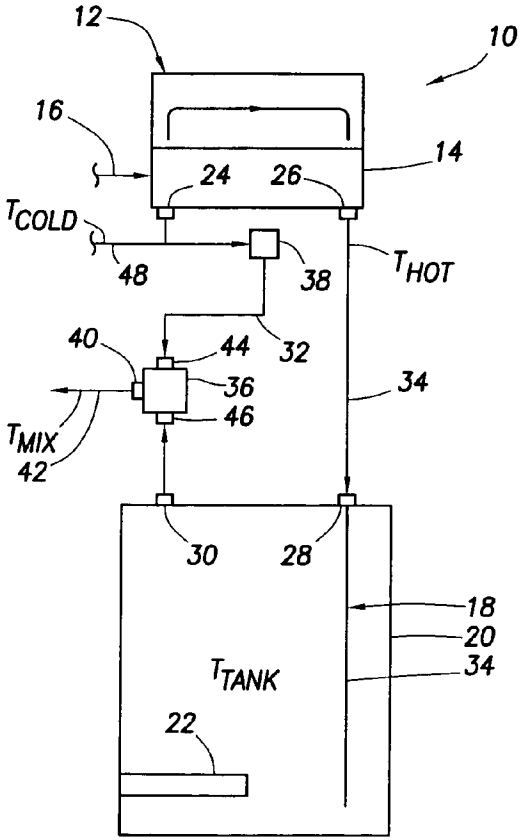
FIG. 1 is a schematic diagram of a specially designed pumpless, combination instantaneous/storage water heating system embodying principles of the present invention.

Schematically depicted in FIG. 1 is a specially designed, preferably pumpless water heater heating system 10 that embodies principles of the present invention and includes an instantaneous gas water heater (IGWH) 12 having a burner section 14 supplied with gaseous fuel via a gas supply line 16, and a storage type water heater (SWH) 18 having a water storage tank 20 with an electric heating element 22 extending into its interior. IGWH 12 has a water inlet 24, and a water outlet 26 extending into its interior. IGWH 12 has a water inlet 24, and a water outlet 26, and tank 20 has a water inlet 28 and a water outlet 30.

A water line 32 is interconnected between the IGWH inlet 24 and the tank outlet 30, and a water line 34 is interconnected between the IGWH outlet 26 and the tank inlet 28 and extends from the tank inlet 28 downwardly through the interior of the tank 20 to a bottom portion thereof. Valves 36 and 38 are operatively connected as shown in the water line 32. Valve 36 is a mixing valve, representatively a thermostatically controlled mixing valve, having an outlet 40 to which a mixed water supply line 42 is connected, and a pair of inlets 44,46 to which the indicated opposite segments of line 32 are connected. Valve 38 is a bypass valve controllable to allow a selectively variable flow of incoming cold water therethrough via the line 32 in the direction of the arrows in line 32. A cold water inlet line 48 (through which incoming cold water is flowed to the system) is connected as shown in the line 32 between the IGWH inlet 24 and the valve 38 as shown.

During a demand for hot water supply from the system 10, pressurized hot water at temperature $T_{TANK}$ is discharged from the tank outlet 30 to the inlet 46 of the mixing valve 36 while at the same time pressurized cold water, at temperature $T_{COLD}$, from a source, is flowed through line 48 into the segment of the line 32 between the IGWH inlet 24 and the bypass valve 38. A portion of this incoming pressurized cold water is flowed into the through IGWH 12 and discharged therefrom, into the line 34, as heated water, at temperature $T_{HOT}$, which flows into the interior of the tank 20. The balance of the incoming pressurized cold water bypasses IGWH 12 and flows through the valve 38 to the inlet 44 of the mixing valve 36.

The mixing valve 36 appropriately blends the bypassed cold water flow and the tank discharge water flow to send, via line 42, a flow of tempered water, at temperature $T_{MIX}$, to the open fixture(s) served by line 42. As needed (for example during standby periods of the system 10), the electric heating element 22 may be energized to maintain $T_{TANK}$ at an appropriate level.

It is important to note that the unique use of the cold water bypass valve 38 in the overall interconnecting flow circuitry of the system 10 advantageously permits the selective variation of the water flow through IGWH 12. The selective bypassing of cold inlet water around IGWH 12 helps reduce low temperatures and condensation in the heat exchanger portion of IGWH 12. The bypass ratio of valve 38 may be fixed or adjustable with respect to the outlet temperature $T_{HOT}$.

As previously mentioned herein, system 10 efficiently functions without the expense of a pump and its associated recirculation piping (although such a pump and associated recirculation piping could be appropriately added to the system if desired). Instead, the "driving" force selectively flowing the tempered water to the plumbing fixture(s0 via pipe 42 is simply the pressure of the cold water source coupled to the pipe 42. Additionally, the combination system 10 is provided with improved temperature control and flow control through IGWH 12 due to the provision of the cold water bypass valve 38 in the piping circuitry interconnecting IGWH 12 and SWH 18.

To control the degree of cold water bypassing IGWH 12 effected by the bypass valve 38, a suitable electronic controller 50 (see FIG. 3) may be utilized to output a control signal 52 to the cold water bypass valve 38, the magnitude of the control signal 52 being related in a predetermined manner to the magnitudes of input signals 54,56,58,60 respectively indicative of $T_{TANK}$, $T_{HOT}$, $T_{MIX}$ and $T_{COLD}$.

Figure 4:
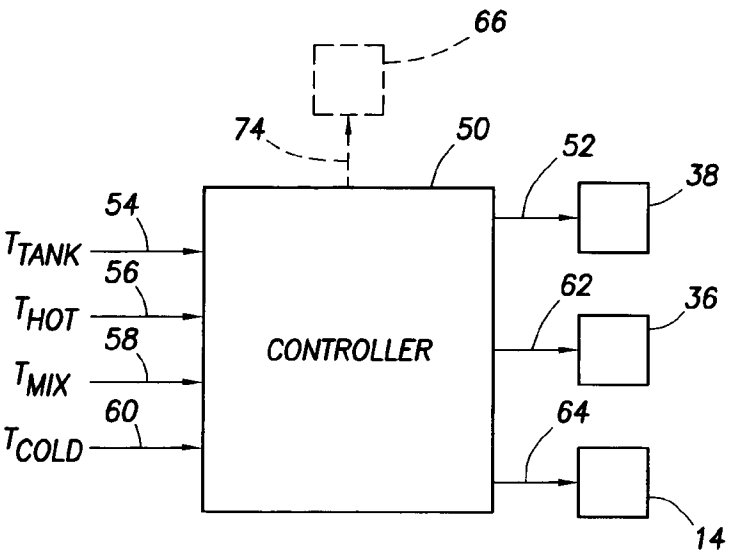
FIG. 4 is a schematic diagram illustrating an alternate embodiment of the controller used to control an alternate electronic mixing valve portion of the FIG. 2 system as well as a cold water directional bypass valve portion thereof.

As previously mentioned, the mixing or tempering valve 36 shown in FIG. 1 is representatively a thermostatic mixing valve in which a temperature setting of $T_{MIX}$ controls the blending of cold water and tank discharge water to achieve the desired temperature $T_{MIX}$. Alternatively, the valve 36 could be an electronically controlled mixing valve. In this case, as shown in FIG. 4, in addition to controlling the cold water bypass valve 38 as a function of the magnitudes of the temperature input signals 54,56,58,60, the controller 50 also uses the temperature input signals 54,56,58,60 to control the electronic mixing valve 36, via an output signal 62, and to modulatingly control the IGWH burner 14, via an output signal 64.

Figure 2:
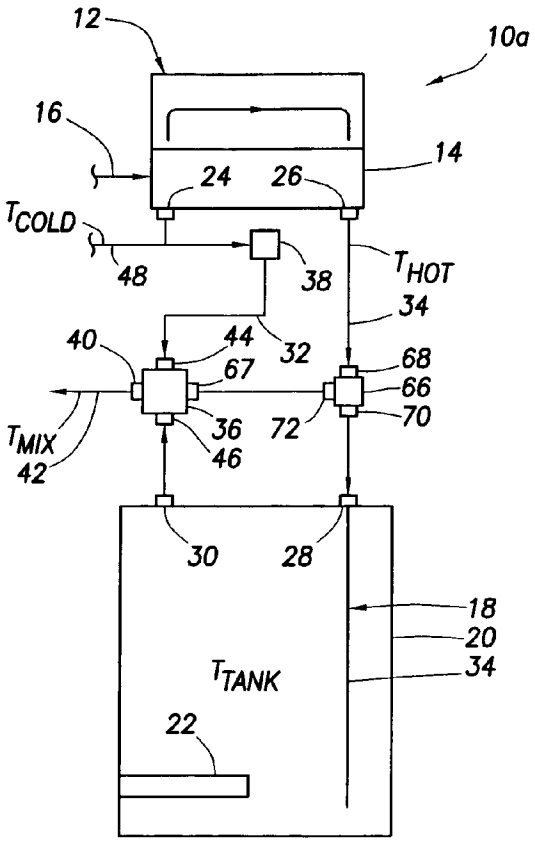
FIG. 2 is a schematic diagram of an alternate embodiment of the FIG. 1 system.

An alternate embodiment 10*a* of the previously described pumpless water heating system 10 is schematically depicted in FIG. 2. System 10*a* is identical to system 10 with the exceptions that (1) mixing valve 36 has an additional inlet 67 thereon, and (2) a directional bypass valve 66 is operatively connected in the line 34 and has an inlet 68 coupled to the IGWH outlet 26, an outlet 70 coupled to the tank inlet 28, and an outlet 72 coupled to the mixing valve inlet 67. The directional bypass valve 66 is controllable to flow all of the hot water exiting IGWH 12 to the tank 20, all of the hot water exiting IGWH 12 to the mixing valve 36 (thereby bypassing the tank 20), or selectively flow variable amounts of the hot water exiting IGWH 12 through the tank 20 and to the valve 36. This feature of the invention provides for substantially improved flexibility in the utilization of the tank 20.

Figure 3:
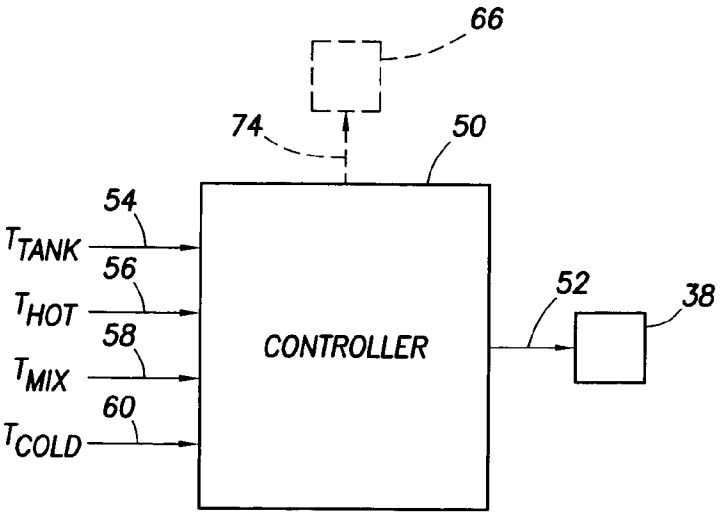
FIG. 3 is a schematic diagram illustrating a controller used to control a thermostatic mixing valve portion of the FIG. 1 system.

When the valve 36 of the system 10*a* is a thermostatic mixing valve, the FIG. 3 control system may be used in conjunction with the system 10*a* by using the controller 50, via an output signal 74, to control the directional bypass valve 66. The cold water and directional bypass valves 38 and 66 in system 10*a* may be controlled with feedback from $T_{HOT}$, $T_{MIX}$ and $T_{TANK}$ to optimize the supply water temperature $T_{MIX}$. In a similar fashion, when the valve 36 of the system 10*a* is an electronically controlled mixing valve, the FIG. 4 control system may be used in conjunction with the system 10*a* by using the controller 50, via output signal 74, to control the directional bypass valve 66.

As can be readily seen from the foregoing, the representatively illustrated embodiments 10,10*a* of the pumpless water heater system of the present invention, compared to conventional combination instantaneous/tank type water heater systems, provide improved water temperature and flow rate control, while at the same time eliminating the complexity and cost of an associated mechanical pumping system.

While the pumpless systems 10,10*a* illustrated and described herein are representatively water heating systems, principles of the present invention are not limited to water heating but could be alternatively employed to advantage in conjunction with supply systems for other types of fluids. Additionally, while as previously mentioned herein the systems 10,10*a* are representatively of pumpless configurations, various types of pumps and associated recirculation systems could be appropriately incorporated therein if desired.

The foregoing detailed description is to be clearly understood as being given by way of illustration and example only, the spirit and scope of the present invention being limited solely by the appended claims.

What is claimed is:

1. Fluid heating apparatus comprising:

an instantaneous fluid heater;

a fluid storage vessel; and flow circuitry, interconnected between said instantaneous fluid heater and said fluid storage vessel, via which an incoming fluid may be sequentially flowed through said instantaneous fluid heater and said fluid storage vessel for discharge from said apparatus as heated fluid, said flow circuitry including (1) an incoming fluid bypass valve operable to cause a selectively variable portion of the incoming fluid to bypass said instantaneous fluid heater, and (2) a mixing valve connected in series with said incoming fluid bypass valve and operable to blend the bypassed fluid and heated fluid exiting said fluid storage vessel to maintain a predetermined temperature of heated fluid discharged from said apparatus.

2. The fluid heating apparatus of claim 1 wherein:

said instantaneous fluid heater is fuel-fired.

3. The fluid heating apparatus of claim 1 further comprising:

a heating structure selectively operable to add auxiliary heat to fluid in said fluid storage vessel.

4. The fluid heating apparatus of claim 3 wherein:

said heating structure is an electrical heating structure.

5. The fluid heating apparatus of claim 1 further comprising:

control apparatus for automatically controlling said incoming fluid bypass valve.

6. The fluid heating apparatus of claim 5 wherein:

said control apparatus is operative to control said incoming fluid bypass valve as a function of the temperature of fluid in said fluid storage vessel, the temperature of heating fluid being discharged from said instantaneous fluid heater, the temperature of heated fluid being discharged from said fluid heating apparatus, and the temperature of the incoming fluid.

7. Fluid heating apparatus comprising:

an instantaneous fluid heater;

a fluid storage vessel; and flow circuitry, interconnected between said instantaneous fluid heater and said fluid storage vessel, via which an incoming fluid may be sequentially flowed through said instantaneous fluid heater and said fluid storage vessel for discharge from said apparatus as heated fluid, said flow circuitry including (1) an incoming fluid bypass structure operable to cause a selectively variable portion of the incoming fluid to bypass said instantaneous fluid heater, and (2) a mixing structure operable to blend the bypassed fluid and heated fluid exiting said fluid storage vessel to maintain a predetermined temperature of heated fluid discharged from said apparatus, said flow circuitry further including a directional fluid bypass structure operative to receive heated fluid exiting said instantaneous fluid heater and flow selectively variable portions of the exiting heated fluid respectively to said mixing structure and to said fluid storage vessel, and wherein said mixing structure is further operable to blend fluid it receives from said directional fluid bypass structure with the bypassed fluid and the heated fluid exiting said fluid storage vessel to maintain said predetermined temperature of heated fluid discharged from said apparatus.

8. The fluid heating apparatus of claim 7 further comprising:

control apparatus for automatically controlling said directional fluid bypass structure.

9. The fluid heating apparatus of claim 8 wherein:

said control apparatus is operative to control said directional fluid bypass structure as a function of the temperature of fluid in said fluid storage vessel, the temperature of heated fluid being discharged from said instantaneous fluid heater, and the temperature of heated fluid being discharged from said fluid heating apparatus.

10. The fluid heating apparatus of claim 9 wherein:

said instantaneous fluid heater has a fuel burner portion, and said control apparatus is further operative to control said fuel burner portion.

11. The fluid heating apparatus of claim 1 wherein:

said fluid heating apparatus is of a pumpless construction.

12. The fluid heating apparatus of claim 7 wherein:

said fluid heating apparatus is of a pumpless construction.

13. Fluid heating apparatus comprising:

an instantaneous fluid heater;

a fluid storage vessel; and flow circuitry, interconnected between said instantaneous fluid heater and said fluid storage vessel, via which an incoming fluid may be sequentially flowed through said instantaneous fluid heater and said fluid storage vessel for discharge from said apparatus as heated fluid, said flow circuitry including:

(1) a directional fluid bypass structure operative to receive heated fluid exiting said instantaneous fluid heater and flow selectively variable portions of the exiting heated fluid respectively into said fluid storage vessel and through a path bypassing said fluid storage vessel, and (2) a mixing structure operative to receive and blend flows of the incoming fluid, the fluid bypassing said fluid storage vessel, and heated fluid exiting said fluid storage vessel to maintain a predetermined temperature of heated fluid discharged from said apparatus.

14. The fluid heating apparatus of claim 13 further comprising:

a heating structure selectively operable to add auxiliary heat to fluid in said fluid storage vessel.

15. The fluid heating apparatus of claim 14 wherein:

said heating structure is an electrical heating structure.

16. The fluid heating apparatus of claim 13 wherein:

said instantaneous fluid heater is fuel-fired.

17. The fluid heating apparatus of claim 13 further comprising:

control apparatus for automatically controlling said directional fluid bypass structure and said mixing structure.

18. The fluid heating apparatus of claim 17 wherein:

said control apparatus is operative to automatically control said directional fluid bypass structure and said mixing structure as a function of the temperature of fluid in said fluid storage vessel, the temperature of heated fluid being discharged from said instantaneous fluid heater, and the temperature of heated fluid being discharged from said fluid heating apparatus.

19. The fluid heating apparatus of claim 18 wherein:

said instantaneous fluid heater has a fuel burner portion, and said control apparatus is further operative to control said fuel burner portion.

20. The fluid heating apparatus of claim 13 wherein:

said fluid heating apparatus is of a pumpless construction.

21. A combination instantaneous/storage type water heater system comprising:

a fuel-fired instantaneous water heater;

a storage type water heater;

piping interconnecting said instantaneous and storage type water heaters in series and via which pressurized incoming water to be heated may be flowed sequentially through said instantaneous and storage type water heaters;

an incoming water bypass valve interconnected in said piping and operable to cause a selectively variable portion of the pressurized incoming water to bypass said instantaneous water heater;

a mixing valve interconnected in said piping and operable to blend the bypassed water and heated water exiting said fluid storage vessel to maintain a predetermined temperature of heated fluid discharged from said water heater system; and control apparatus for automatically controlling said incoming water bypass valve and said mixing valve.

22. The water heater system of claim 21 wherein:

said water heater system is of a pumpless construction.

23. The water heater system of claim 21 further comprising:

a directional bypass valve interconnected in said piping and operative to receive heated water exiting said instantaneous water heater and flow selectively variable portions of the exiting heated water respectively to said mixing valve and to said storage type water heater, and wherein said mixing valve is further operable to blend water it receives from said directional bypass valve with the bypassed incoming water and the heated water exiting said storage type water heater to maintain said predetermined temperature of heated water discharged from said water heater system, and said control apparatus is further operable to automatically control said directional bypass valve.

24. The water heater system of claim 23 wherein:

said water heater system is of a pumpless construction.

25. The water heater system of claim 21 wherein:

said storage type water heater comprises a water storage tank and an electrical heating structure selectively operative to heat water disposed within said water storage tank.

* * * * *